United States Patent [19]

Peters et al.

[11] 4,067,619

[45] Jan. 10, 1978

[54] LONGWALL MACHINE GUIDE WITH DETACHABLE COVER PLATE

[75] Inventors: Wolfgang Peters, Selm; Alois Hauschopp, Werne; Gerhard Merten, Lunen, all of Germany

[73] Assignee: Gewerkschaft Eisenhutte Westfalia, Lunen, Germany

[21] Appl. No.: 719,232

[22] Filed: Aug. 31, 1976

[30] Foreign Application Priority Data

Sept. 10, 1975 Germany ..... 2540215

[51] Int. Cl.[2] ..... E21C 35/12

[52] U.S. Cl. ..... 299/43

[58] Field of Search ..... 299/32, 34, 43

[56] References Cited

U.S. PATENT DOCUMENTS

| | | | |
|---|---|---|---|
| 3,456,983 | 7/1969 | Rassmann | 299/34 |
| 3,703,315 | 11/1972 | Trolley | 299/34 |

FOREIGN PATENT DOCUMENTS

| | | | |
|---|---|---|---|
| 1,277,181 | 9/1968 | Germany | 299/34 |

*Primary Examiner*—Ernest R. Purser

*Attorney, Agent, or Firm*—Thompson, Birch, Gauthier & Samuels

[57] ABSTRACT

A guide for a mining machine, such as a plough, is constructed from a series of interconnected sections arranged end-to-end and secured with bolts to the mineral face side wall of a conveyor. Each guide section is composed of an L-shaped plate with an upstanding wall engaging on the conveyor side wall and an inclined foot wall supporting the body of the plough. Spacers locating the securing bolts separate upper and lower chain guide passages and a cover plate extends over the mineral face side of the passages. A slot is formed above the foot wall to allow the plough body to be coupled to the chain in the lower passage. The slot is defined at its upper side by channel-like strips assembled to the spacers and these strips have apertures which receive tongues on the cover plate to thereby form a detachable push-in hinge permitting the cover plate to pivot towards the mineral face. The cover plate is detachably secured to the L-shaped plate at its upper end.

16 Claims, 5 Drawing Figures

LONGWALL MACHINE GUIDE WITH DETACHABLE COVER PLATE

BACKGROUND TO THE INVENTION

The present invention relates to a guide for a mineral mining machine such as a plough.

It is known to guide a mineral winning machine or a mineral loading machine, such as a plough, for movement along a mineral face. For this purpose guides of various designs have been adopted. Normally the guide for the machine or plough would be constructed of individual sections or parts arranged end-to-end and secured to the mineral face side of a scraper-chain conveyor. Conveniently, one guide section or part can be allocated to each channel section or pan of the conveyor. With a view to clearing and loading the material detached from the mineral face of the mine working it is known to provide a ramp-like loading surface on the guide. This ramp-like surface can be produced by cover plates behind which are located upper and lower chain guide passages which receive an endless chain used to propel the machine along the guide.

The machine may be connected to the chain running in the lower passage by way of a narrow slot below the cover plates. It is known to provide a rail formed by welded-on plates at the lower edges of the cover plates to define this slot and to positively guide the machine in the vicinity of the slot. A guide of this type is described in German patent specification No. 1,277,181.

In this known guide construction bearing eyes are welded into the rail at the ends of the guide sections to receive pins which provide pivot joints permitting the cover plates to be pivoted towards the face to permit access to the chain guide passages. This and other mounting systems for the cover plates in the known types of guides are relatively expensive to fabricate and are not particularly stable.

A general object of this invention is to provide an improved guide.

SUMMARY OF THE INVENTION

According to the present invention there is provided a guide for a mineral mining machine; said guide being composed of interconnected parts at least partly defining upper and lower chain guide passages separated from one another by spacers, each guide part having a cover plate on one side of at least the upper chain guide passage and means mounting the cover plate for pivoting to provide access to the interior of the guide, the mounting means being composed of push-in hinges. These push-in hinges may be composed of tongues at the lower edge of the cover plates engaging in apertures or slots in components such as mounting pieces. These mounting pieces can be carried by or secured to and form part of the spacers. The mounting pieces may be hollow components, such as U-shaped channel-like strips secured end-to-end and extending over substantially the entire length of the guide part. Each guide part or section may be, as is known, allocated to one channel section of a scraper-chain conveyor.

The mounting pieces for the push-in hinges may form a defining upper part of a slot permitting connection between the machine or plough and a chain run in the lower chain guide passage and may thereby guide the machine in the lower guide passage.

The push-in hinges for the cover plates are especially simple and cheap to construct. Besides permitting the pivoting of the cover plates these hinges also allow the cover plates to be raised and removed from the other components of the guide. Several such hinges can be provided on each cover plate thus providing adequate support. The simple tongue-in-slot construction for the hinges can be designed so that the tongues also act as a stop limiting the amount of pivoting of the cover plates.

It is preferable to also provide means for locating the upper parts of the cover plates in relation to the other components of the guide. The provision of the location means ensures that the cover plates are supported at their upper parts by this location means and at their lower parts by the aforementioned push-in-hinges. The locating means can be formed between the cover plates and the upstanding wall regions of associated L-shaped plates. Preference is given to a construction wherein the location means comprises components defining interengaging projections and recesses or interengaging surfaces ensuring correct alignment and these components can be disposed at the undersides of upper wall regions of the cover plates and at the upper end parts of the upstanding wall regions of their associated L-shaped plates. The location means defining components can be apertured to receive bolts used to secure the cover plates to the L-shaped plates and these components are preferably arranged in compartments separated by web plates from the upper chain guide passage.

The guide composed of parts as described, would normally be secured to the side wall of a conveyor in known manner by means of bolts engaging through the spacers. The cover plates can then have apertures permitting easy access to nuts engaged on these bolts. The securing bolts may be arranged in one row or several vertically offset rows.

As will become apparent hereinafter the present invention can also provide a guide for guiding a mineral mining machine such as a plough for movement along a scraper-chain conveyor in a mine working; said guide being composed of individual sections arranged end-to-end and secured to the side walls of the channel sections of the conveyor facing a mineral face of the mine working and said guide comprising generally L-shaped plates with upstanding walls engaging on the side walls of the channel sections and inclined lower walls forming a support for the machine in conjunction with the exterior of cover plates, upper and lower chain guide passages separated by spacers and generally defined between the the L-shaped plates and the cover plates, an opening formed above the inclined walls of the L-shaped plates to allow one or more guide arms of the machine to engage in the lower guide passage for attachment to a chain run therein, wherein the cover plates have tongues which engage in apertures to form push-in-hinges permitting the cover plates to be pivoted towards the mineral face.

The invention may be understood more readily and various other features of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
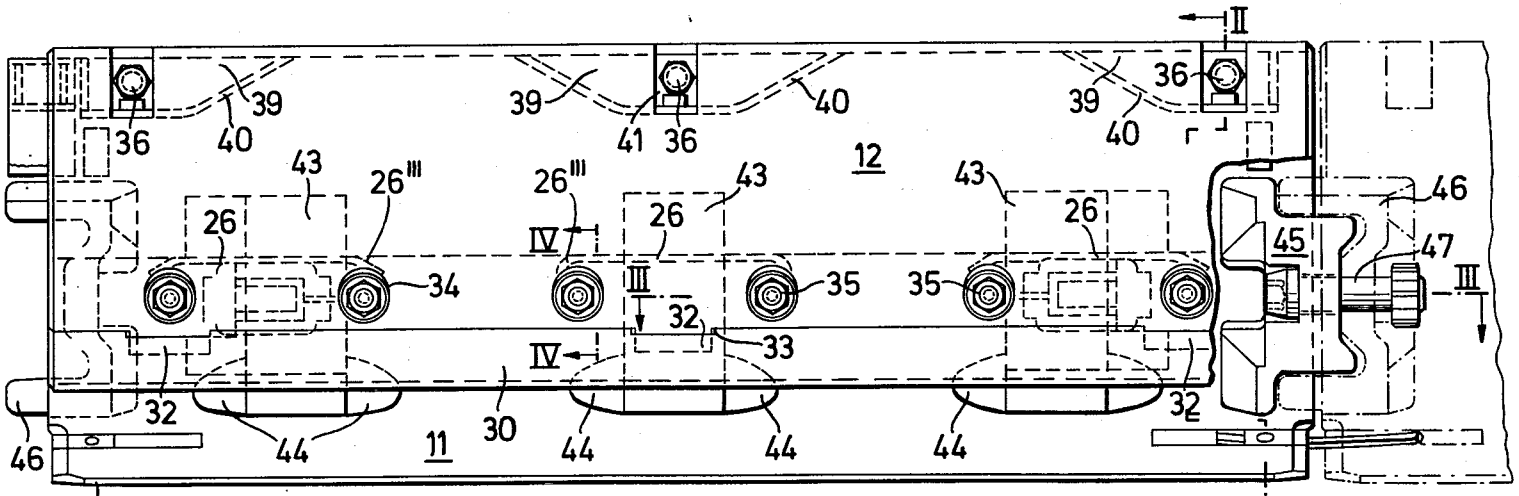
FIG. 1 is a side view of one part of a guide made in accordance with the invention.

A guide made in accordance with the invention and intended for guiding a machine, and more especially a plough, for movement back and forth along a scraper-chain conveyor is composed of individual sections or parts affixed to the side of the conveyor nearest the mineral face. The scraper-chain conveyor is itself composed of individual channel sections or pans and it is convenient to allocate one guide part to each of the pans of the conveyor. The mineral face side wall of one of the conveyor pans is shown in chain-dotted lines and denoted 10 in FIG. 2. The parts of the guide made in accordance with a first embodiment of the invention are connected end-to-end with connecting devices which permit slight articulation between the parts whilst maintaining traction-proof connection between the parts.

Referring now to FIGS. 1 to 4 each guide part is composed of guide surfaces with a lower portion formed by an inclined foot region 11 of a somewhat L-shaped plate 13 and an upper portion formed by a ramp-like cover plate 12. The foot region 11 of the plate 13 has a downwardly-turned edge 11' which engages and rests on the floor of a mine working. The plate 13 has its upstanding wall region 14 secured by means of bolts 15 to the side wall 10 of the conveyor. The bolts 15 have heads 16 which engage behind holders 17 welded into the external V-shaped groove 18 in the side wall 10 and serving primarily as means for securing guard or spill plates to the conveyor pan in known manner.

Figure 2:
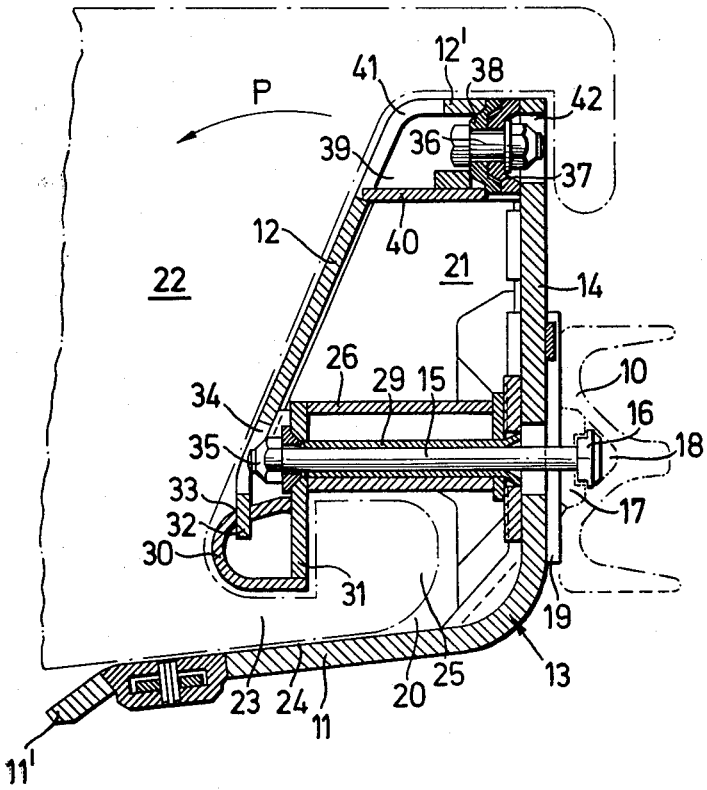
FIG. 2 is a cross-section of the guide part shown in FIG. 1, the view being taken along the line II—II of FIG. 1.

In this construction as shown in FIG. 2, one or more additional plates 19 are interposed between the upstanding wall region 14 of the plate 13 and the side wall 10. The upstanding wall region 14 of the plate 13 projects well above the upper flange of the side wall 10 and forms the inner lateral defining wall of chain guide passages 20, 21 disposed one above the other. These passages 20, 21 receive the upper and lower runs of an endless chain (not shown) which is used to propel the plough along the conveyor in known manner. The plough body is represented diagrammatically by a chain-dotted line and the reference numeral 22 in FIG. 2. The lower run of the chain in the passage 20 which forms the haulage or traction run is connected to the body 22 of the plough via one or more arms 23 which extend through an opening or slot 24 defined at the lower side by the foot region 11 of the plate 13. The arm or arms 23 engage on a guide element 25 disposed in the passage 20 and coupled to the chain.

Figure 3:
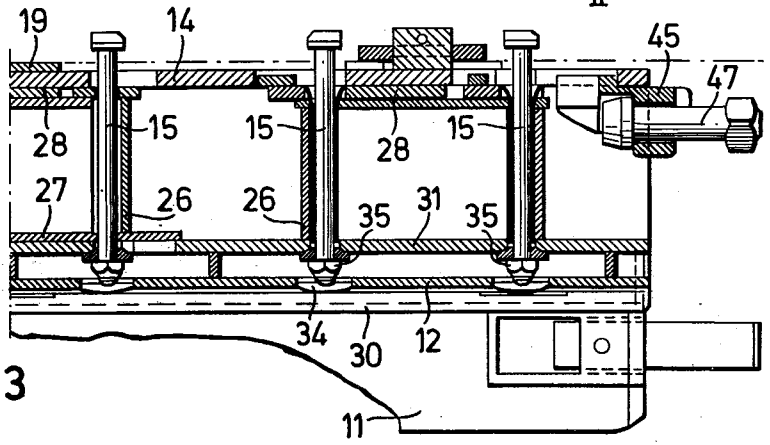
FIG. 3 is a plan view of the guide part shown in FIG. 1, the view being taken along the line III—III of FIG. 1.
Figure 4:
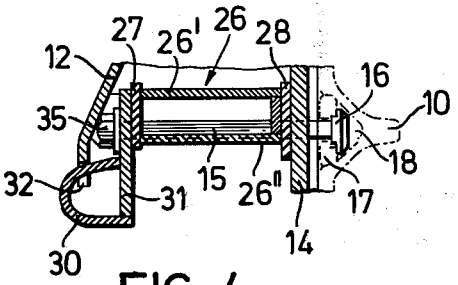
FIG. 4 is a part-sectional end view of the guide part, the view being taken along the line IV—IV of FIG. 1.

The passages 20, 21 for the chain are separated by spacers 26 secured to the upstanding wall region 14 of the plate 13 by means of the bolts 15 mentioned previously. These spacers 26 each extend over only part of the length of the conveyor pan and in this embodiment, as shown, in FIG. 1, three spacers 26 are provided and are spaced apart along the conveyor pan. As can best be seen in FIG. 4, each spacer 26 is composed of flat plates 26', 26" which are spaced one above another with converging ends 26''' (FIG. 1). These plates 26', 26" are interconnected by vertical webs 27, 28 conveniently welded to the sides of the plates 26', 26" to form a shallow hollow box-like component constituting the spacer 26. Sleeves 29 (FIG. 2) are also welded between the plates 26', 26" and the bolts 15 extend through these sleeves 29. As shown in FIG. 3, the spacers 26 are provided at the outer sides with downwardly extending strip-like plates 31 which are detachably mounted and secured with nuts 35 engaged on the bolts 15. The plates 31 each carry a profiled elongate mounting piece 30 which may be a bent over U-shaped component welded with its free edges to the plate 31 as shown in FIG. 4 or else a component formed integrally with the plate 31. The mounting pieces 30 engage end-to-end to extend over substantially the entire length of the conveyor pan and define the upper side of the opening 24. Instead of mounting the plates 31 for detachment, these plates 31 could be fixed and non-detachable, e.g., by welding to the spacers 26. It is however, preferred to fix the outermost plates 31 (FIG. 1) with their mounting piece 30 to the outermost spacers 26 by welding and the webs 27 can here be omitted and replaced by somewhat thicker plates 31 if desired. The central plate 31 with its mounting piece 30 is then detachably secured to the central spacer 26 by means of the nuts 35 of the bolts 15. The central plate 31 would then engage on the outer web 27 of the central spacer 26 as shown in FIG. 4. This arrangement allows the central assembly composed of the spacer 26 and the associated structure 31, 30 to be removed to provide access to the passage 20, 21 between the outermost spacers 26.

As can be appreciated from FIGS. 2 and 4, the plates 31 project downwardly beyond the lower plates 26" of the spacers 26 to form a lateral defining wall of the passage 20 on the mineral face side. The body of the plough 22 is shaped to the arm or arm 23 so as to engage around the mounting pieces 30 and the plates 31 to provide stability.

The cover plate 12 is itself mounted for pivoting downwardly towards the mineral face as denoted by arrow P in FIG. 2 to provide access to the passages 20, 21 and to the interior of the guide part. Push-in hinge joints are provided for this purpose.

More particularly, the lower edge of the plate 12 is formed with a plurality, in this case three, tongues 32 spaced apart longitudinally of the guide and engaging in openings or slots 33 provided in the respective associated mounting pieces 30. There is adequate clearance between the tongues 32 and the openings 33 to permit the pivoting of the plate 12. As shown in FIG. 2 the openings 33 are inclined slightly towards the mineral face to bias the permissible pivoting action towards the mineral face and preferably the clearance for the tongues 32 is such that the latter engage on the interior of the associated mounting piece to provide a stop limiting the downward pivoting movement of the plate 12. The cover plate 12 is also provided with apertures 34 forming windows above the the tongues 32. These apertures 34 coincide with the nuts 35 and permit ready access to the nuts 35 from the exterior.

The cover plate 12 has a bent-over upper wall region 12' which is substantially horizontal and which extends up to the upstanding wall region 14 of the plate 13. The plate 12 is detachably secured to the upper wall region 14 of the plate 13 with the aid of bolts 36. To locate and position the cover plate 12 in relation to the wall region 14 interengaging projections and recesses are provided. These projections and recesses are formed by apertured bell-like shaped components 37, 38 welded to the underside of the upper wall region 12' of the cover plate 12 and to the upper part of the exterior of the wall region 14 of the plate 13. These components 37, 38 have bores which align with one another to receive the bolts 36. Shaped web plates 40 (FIGS. 1 and 2) are welded to the underside of the upper wall region 12' of the cover plate 12 to provide compartments 39 for the components 37, 38 and the bolts 36. These compartments 39 are separated by the web plates 40 from the upper chain passage 21. Conveniently, the web plates 40 form seatings for welding in the components 38. The plate 12 has further apertures 41 forming windows in the juncture zone between the main wall region and the upper wall region 12'. Similar apertures 42 forming windows are provided in the upper part of the wall region 14 of the plate 13. The apertures 41, 42 are arranged to permit access to the bolts 36 and their associated nuts.

As can be appreciated the pivoting of the cover plate 12 (arrow P FIG. 2) would necessitate prodetachment of the bolts 36.

In order to stiffen the cover plate 12, supports 43 are welded in the internal part thereof. The supports 43 — three in number as shown in FIG. 1 — carry guide blocks at their lower side edges which are designed to guide the chain in the passage 20 past the supports 20 in the vicinity of the mounting pieces 30.

The ends of the wall region 14 of the plate 13 has welded on coupling devices 45, 46 which combine to form an interengaging spigot and recess. These devices 45, 46 mate with complementary devices 46, 45 on adjacent guide parts on the adjacent conveyor pans and receive bolts 47. These connections provide the aforementioned slight angular mobility while resisting traction force.

Figure 5:
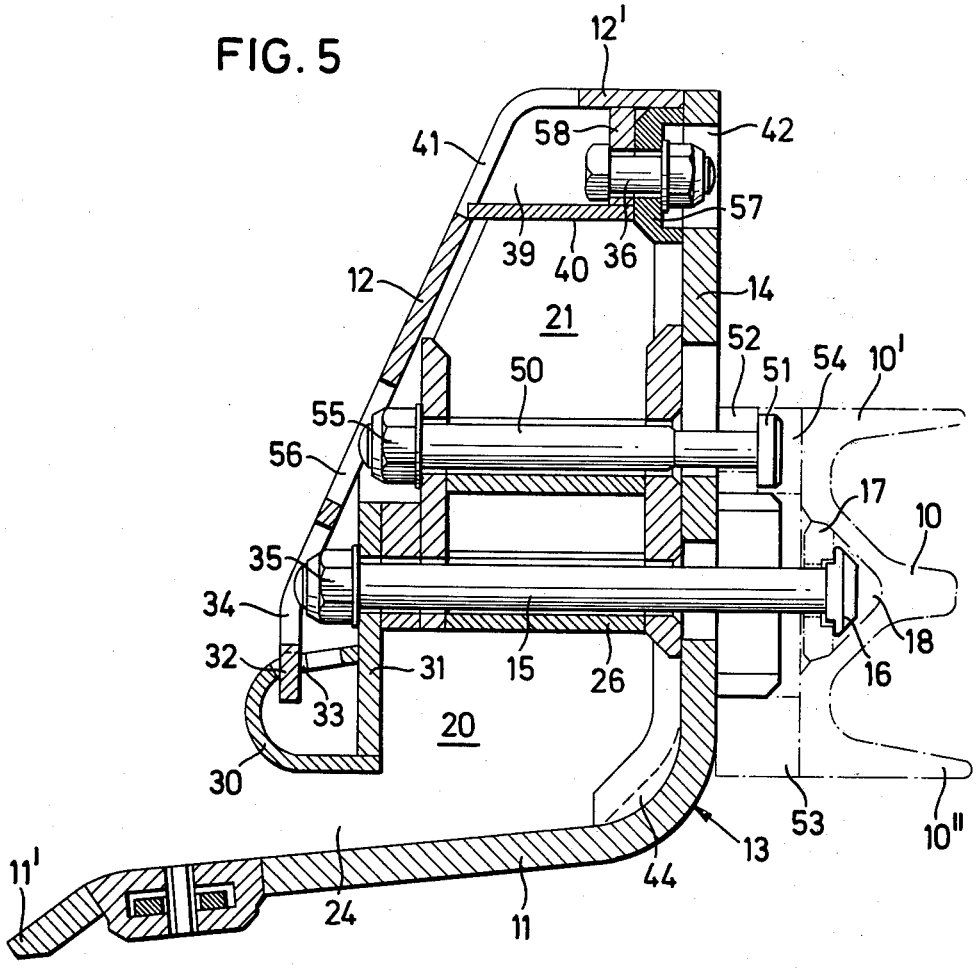
FIG. 5 is a cross-section of a part of a further guide made in accordance with the invention with the view generally corresponding to FIG. 2 but being taken on a somewhat enlarged scale.

The modified guide part represented in FIG. 5 is essentially similar to that described and illustrated in the other Figures and hence like parts carry the same reference numerals. A detailed explanation of the modified guide part is thought to be unnecessary and only the modifications or difference will now be described. As shown in FIG. 5, two rows of bolts 15, 50 are used for the attachment of the guide part to the conveyor side wall 10. The bolts 15 have their heads engaged behind the holders 17 while the heads 51 of the bolts 50 engage behind a strip 52 welded or otherwise secured to the side wall 10. The strip 52 is aligned with its upper edge flush with the upper flange 10' of the side wall 10. A further strip 53 is located beneath the strip 52 and is similarly aligned with the lower flange 10" of the side wall 10. The strips 52, 53 can extend over substantially the entire length of the conveyor pan and also serve to reinforce the side wall 10. The reinforcement can be enhanced by interconnecting the strips 52, 53 with vertical connection pieces. The upper strip 52 is provided with pocket-like recesses 54 distributed over its length and positively receiving the heads 51 of the bolts 50. These bolts 50 project through a built-up spacer or spacers 26 and receive nuts 55 located within the cover plate 12. The plate 12 is provided with additional window-forming apertures 56 to provide access to these nuts 55 generally disposed above the nuts 35 for the bolts 15. By way of example some four bolts 15, 50 can be provided in each row along the conveyor pan and the guide part. The separate rows of bolts provide an especially stable connection between the guide part and the conveyor pan.

The components 37, 38 in the embodiment of FIGS. 1 to 4 are replaced in the construction of FIG. 5 by simple strip-like plates 57, 58 which engage one another and which are apertured to receive the bolts 36. The location of the cover plate 12 can here be accomplished by the end margin of the upper wall region 12' engaging over the upper ends of the plates 57.

In the guide part shown in FIG. 5, only one spacer 26 is preferably provided which is nevertheless somewhat shorter than the overall length of the conveyor pan and guide part.

This provides a reasonably large gap between the spacers 26 of adjacent guide parts to permit adequate access to the passage 20 when the plates 12 are pivoted outwards. The provision of a single spacer which is of somewhat stouter construction than the individual spacers 26 in the embodiment of FIGS. 1 to 4 also enhances the stability of the guide. It is also quite feasible for a single long spacer 26 to take the place of the three spacers 26 in the guide part shown in FIGS. 1 to 4.

We claim:

1. In a guide for a mineral mining machine; said guide being composed of interconnected parts at least partly defining upper and lower chain guide passages separated from one another by spacers with each guide part having a cover plate on the outer side of at least the upper chain guide passage and means for mounting the cover plate for pivoting to provide access to the interior of the guide; the improvement comprising constructing the mounting means for the cover plate as a detachable push-in hinge having tongues protruding downwardly from the lower edge of said cover plate into apertures in a mounting piece underlying said lower edge and carried by said spacers.

2. A guide according to claim 1, wherein said mounting piece is a U-shaped strip carried by a plate depending from said at least one spacer.

3. A guide according to claim 1, wherein the guide part has a plurality of said mounting pieces and a plurality of spacers, the spacers being spaced apart along the guide part and the mounting pieces extending end-to-end along substantially the entire length of the guide part.

4. A guide according to claim 1, wherein each guide part has a single spacer which is shorter than the overall length of the guide part.

5. A guide according to claim 1, wherein a slot is provided for permitting connection between a body of the machine to be guided and a chain in the lower chain guide passage, said slot being defined between the mounting pieces and subjacent guide surfaces serving to support the body of the machine.

6. A guide according to claim 5, wherein the subjacent guide surfaces are formed by inclined foot regions of L-shaped plates having upstanding wall regions inwardly defining the guide passages.

7. A guide according to claim 6, wherein there is provided means for locating the upper part of each of the cover plates, said locating means being formed between the cover plates and the upstanding wall regions of the associated L-shaped plates.

8. A guide according to claim 7, wherein the location means comprises components defining interengageable projections and recesses; said components being attached to the underside of an upper wall region of the lower plate and to the upper end part of said upstanding wall region of the L-shaped plate.

9. A guide according to claim 8, wherein said components forming the location means are apertured to receive bolts used to detachably secure the cover plate to the upstanding wall region of the L-shaped plate of the guide part.

10. A guide according to claim 9, wherein the cover plates have apertures permitting release of the bolts of their associated location means.

11. A guide according to claim 1, wherein the guide parts are secured to a conveyor side wall with bolts engaging through the spacers.

12. A guide according to claim 11, wherein the cover plate of each guide part has apertures therein permitting access to nuts engaged on the bolts.

13. A guide according to claim 1, wherein there is provided means for locating the upper part of the cover plate of said guide part.

14. A guide according to claim 13, wherein the location means are plural location means arranged in compartments separated from the upper chain guide passage of said guide parts by shaped web plates secured to the cover plates.

15. A guide for guiding a mineral mining machine such as a plough for movement along a scraper-chain conveyor in a mine working; said guide being composed of individual sections arranged end-to-end and secured to the side walls of the channel sections of the conveyor facing a mineral face of the mine working and said guide comprising generally L-shaped plates with upstanding walls engaging on the side walls of the channel sections and inclined lower walls forming a support for the machine in conjunction with the exterior of cover plates, upper and lower chain guide passages separated by spacers and generally defined between the L-shaped plates and the cover plates, an opening formed above the inclined walls of the L-shaped plates to permit guided connection between the body of the machine and a chain run in the lower guide passage, wherein the cover plates have tongues which protrude downwardly from the lower edges thereof into apertures in a mounting piece underlying said lower edges, said mounting piece being carried by said spacers, the said tongues thus cooperating with said apertures to form push-in hinges permitting the cover plates to be pivoted about their lower edges towards the mineral face.

16. In a guide for a mineral mining machine, said guide composed of interconnected parts at least partly defining upper and lower chain guide passages separated one from the other by spacers, with each guide part having a cover plate on the outer side of at least the upper chain guide passage, means for mounting the cover plate for pivoting to provide access to the interior of the guide, comprising: a mounting piece underlying the bottom edge of the cover plate, said mounting piece being assembled to at least one of said spacers and having apertures therein arranged to receive tongues protruding downwardly from the bottom edge of the cover plate, whereupon the cover plate is pivotable about its bottom edge on said mounting piece; and, means for detachably connecting the upper part of the cover plate to an upstanding wall region on said guide part.

* * * * *